United States Patent [19]

Harting et al.

[11] Patent Number: 4,867,710

[45] Date of Patent: Sep. 19, 1989

[54] PIN-SHAPED CONTACT ELEMENT THAT CAN BE FIXED IN PRINTED CIRCUIT BOARD BOREHOLES

[75] Inventors: Dietmar Harting, Espelkamp; Hans Nagel, Porta Westfalica; Horst Nowacki, Lübbecke; Hartmuth Schmidt, Ostercappeln, all of Fed. Rep. of Germany

[73] Assignee: Harting Elektronik GmbH, Espelkamp, Fed. Rep. of Germany

[21] Appl. No.: 301,940

[22] Filed: Jan. 25, 1989

[30] Foreign Application Priority Data

Feb. 10, 1988 [DE] Fed. Rep. of Germany ..... 3804041

[51] Int. Cl.[4] ..... H01R 13/41

[52] U.S. Cl. ..... 439/757; 439/82

[58] Field of Search ..... 439/82, 84, 757

[56] References Cited

U.S. PATENT DOCUMENTS

| | | | |
|---|---|---|---|
| 4,606,589 | 8/1986 | Elsbree et al. | 439/751 X |
| 4,762,498 | 8/1988 | Harting et al. | 439/751 X |
| 4,768,980 | 9/1988 | Collier | 439/751 |
| 4,793,817 | 12/1988 | Hiesbock | 439/751 X |

*Primary Examiner*—Eugene F. Desmond

*Attorney, Agent, or Firm*—Jordan and Hamburg

[57] ABSTRACT

A pin-shaped contact element that can be fixed in printed circuit board boreholes, preferably in metallized printed circuit board boreholes, has a fastening section with two parallel side parts that can move elastically towards one another and a gradually tapering insertion region, the elasticity of the insertion region being increased by providing in the insertion region an opening which runs transversely to the connecting web of the side parts and interrupts this connecting web in the transition or connecting region to the lower end of the pin.

7 Claims, 2 Drawing Sheets

PIN-SHAPED CONTACT ELEMENT THAT CAN BE FIXED IN PRINTED CIRCUIT BOARD BOREHOLES

The invention relates to a pin-shaped contact elements that can be fixed in printed circuit board boreholes, preferably in metallized printed circuit board boreholes, with a fastening section, which has two parallel side parts that can move towards one another, the side parts being connected together by an elastic or springy deformable, connecting web and a gradually tapering insertion region being provided before (in the insertion direction) the fastening section.

Such contact elements are preferably provided for pressing into metalized printed circuit boards. After the contact elements are pressed in, the edges of the side parts are connected in intimate contact with the borehole metallization.

At the same time, it must be assured that the contact element is pressed into the printed circuit board borehole as gently as possible, that is, that the borehole metallization there is not excessively stressed locally.

Such a contact element is known, for example, from the German Pat. No. 3,210,348. It is also known that the insertion region can be designed so as to taper gradually, so that the contact element will be pressed into the borehole gently and uniformly.

However, despite these measures, it has turned out that the stiffness of the insertion region is relatively high. Consequently, when a contact element with such a design is pressed in, the printed circuit board borehole or metallization is greatly expanded on the pin insertion side. Frequently this is associated with a tearing of the metallization. It may even happen that, depending on the tolerance situation of the pins and of the printed circuit board borehole, that the "metallization sheath" tears off from the connecting conductor strip, and a satisfactory contact is no longer guaranteed.

Furthermore, on pressing in the fastening section, the tin layer of the wall of the borehole frequently is scraped off and pressed out of the borehole. This, in turn, easily leads to unintended connections between adjoining contact elements due to the tin particles. It is therefore an object of the present invention, in connection with a contact element of the type mentioned in the introduction, to make the insertion section significantly more elastic, so that damage/excessive deformation of the printed circuit board metallization is reliably avoided when the contact element is pressed in. However, the contacting properties/contact forces in the area of the fastening section should be retained fully and completely. Moreover, a scraping off or pushing our of the tin particles of the customarily provided tin layer of the borehole metallization should also be prevented.

This objective is accomplished in a technically advanced manner by providing in the insertion region an opening, which runs transversely to the connecting web, so that the connecting web is interrupted in the transition region or connecting region to the lower end of the pin.

The advantages achieved with the invention consists particularly in that the insertion region is considerably more elastic than in known designs of contact elements, which are to be pressed into printed circuit board boreholes, so that the mechanical stress on the printed circuit board borehole, especially at the upper side of the printed circuit board, is considerably reduced when the contact element is pressed in. At the same time, the forces required to press the contact element into the borehole, especially the initial forces, are reduced. Furthermore, the relatively soft pressing-in process also prevents excessive stress on the tin coating of the borehole metallization, thus preventing abraded tin or tin particles being pressed out of the printed circuit borehole during the press-in process.

Especially for contact elements, the front end of the pin of which is designed as a long post for a wire-wrap technique, it is a further advantage that the inventive design of the insertion region counteracts a possible tendency of the post to assume a slated position after the press-in process. The reason for this is as follows. The connecting web of the side parts of the fastening section, which bends flexibly during the press-in process and thus exerts bending forces on the adjoining post, is mechanically separated from the post connection and thus does not transfer to the post any tensile or compressive stresses which could cause deformation. An example of the operation of the invention is shown in the drawings and will be described in greater detail below.

DESCRIPTION OF THE PREFERRED EMBODIMENTS

Figure 1:
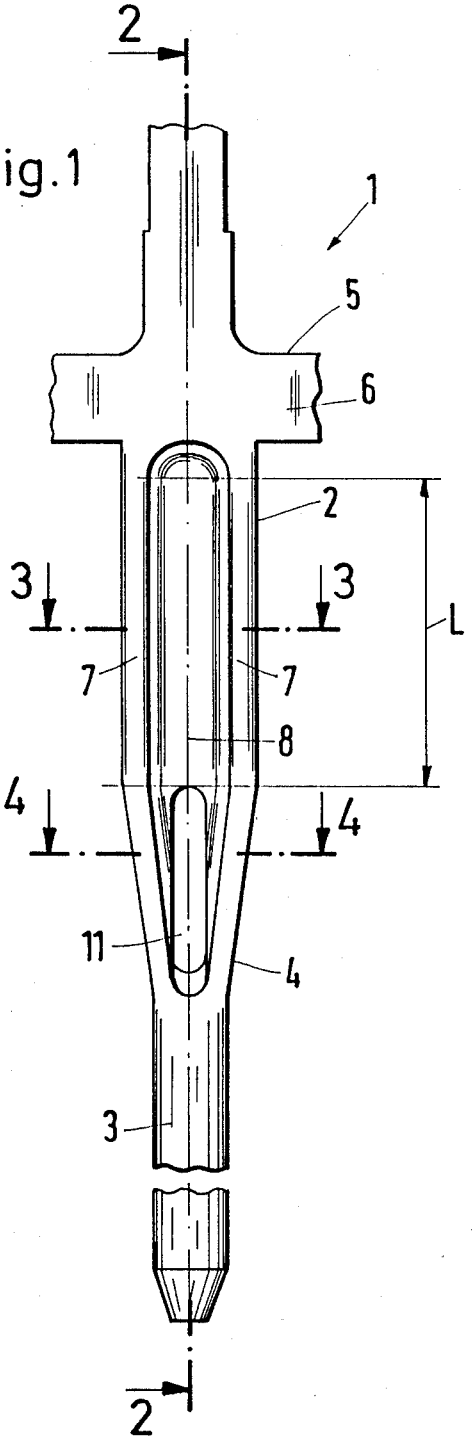
FIG. 1 shows a section of a contact element.
Figure 2:
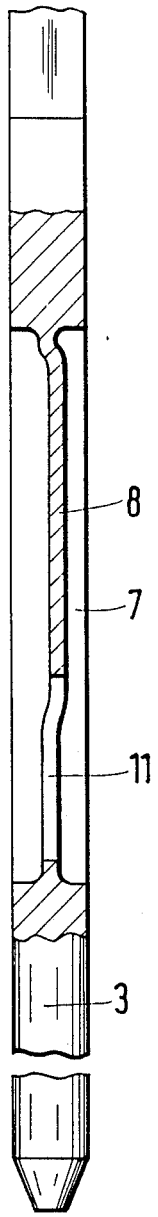
FIG. 2 shows a sectional view of the contact element of FIG. 1 taken along the line 2—2 in FIG. 1.

FIGS. 1 and 2 show a contact element 1. Only the regions that are essential to an understanding of the present invention are shown. The contact element essentially comprises a fastening section 2 with an adjacent insertion region 4 which tapers gently towards the lower end of the pin 3. The lower end of the pin is designed here as a square post for the so-called wire-wrap technique. Towards the top, an enlarged projection 6 adjoins the fastening section. The projection 6 is constructed with support shoulders 5 for a press-in tool or as a fastening part in an insulating body. The projection 6, in turn, adjoins a contact region, the details of which are not shown here and which may be constructed as a knife contact or a spring contact.

Figure 3:
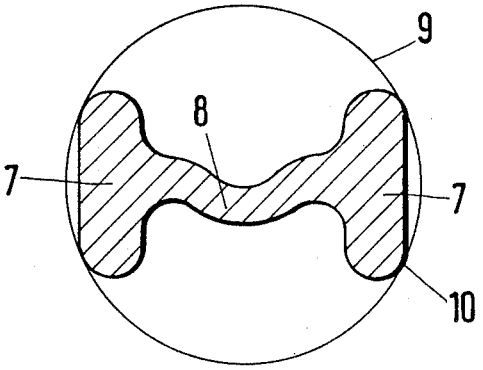
FIG. 3 shows a sectional view of the fastening section of the contact element of FIG. 1 taken along the line 3—3 on an enlarged scale.

As shown in FIG. 3, the fastening section 2 is provided with two exterior, parallel side parts 7, which are connected together through a corrugated, spring-like connecting web 8. When a contact element is pressed into a printed circuit board borehole with a diameter smaller than that of the surrounding circle 9, the details of which are not shown here, the side parts are moved towards one another and the connecting web is deformed in spring-like fashion. At the same time, the outer edges 10 of the side parts are pressed firmly against the wall of the borehole metallization.

The effective length of the fastening section is labeled L in FIG. 1.

Figure 4:
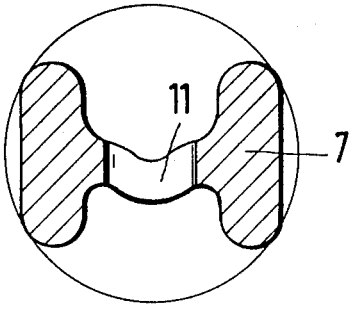
FIG. 4 shows a sectional view of the insertion region of the contact element of FIG. 1 taken along the line 4—4 on an enlarged scale.

As already mentioned, a tapered region 4 is provided before (in the insertion direction of the contact element) the fastening section. This causes the contact element to be immersed and pressed gently into the printed circuit board borehole. The cross section of this region is shown in FIG. 4. The connecting web and the side parts also run out at the tapered end of this region, that is, the approximately H-shaped cross section of the fastening section goes over into the square cross section of the pin end.

To increase the elasticity of the insertion region, an opening 11 is provided here, which extends transversely to the connecting web, thus interrupting it.

This opening is advantageously designed as a longitudinal hole which extends over the entire length of the insertion region. Moreover, the width of the opening or of the longitudinal hole is dimensioned so that, when the contact element is pressed into the borehole and the insertion region is thereby deformed, the opposite side part of this region can make mutual contact at most at the minimum diameter of the printed circuit board borehole. Through this measure the elasticity of the insertion region is decisively increased, since the side parts in this region can now move freely towards one another and only as the depth of insertion of the contact element into the printed circuit borehole increases, does the actual fastening section gradually enter the borehole, the fastening being taken over fully by this section after the final depth of penetration is reached.

What we claim is:

1. A contact element for insertion in an opening of a printed circuit board comprising a fastening section, a tapered insertion section, and a connection section, said tapered insertion section being intermediate said fastening section and said connection section, said fastening section having longitudinally extending and generally parallel side parts joined to a resilient connecting web, said tapered insertion section having side parts and an opening between said side parts such that said side parts of said tapered insertion section are moveable toward one another into the space defined by said opening during insertion into said opening to thereby increase the resiliency of said tapered insertion section.

2. A contact element according to claim 1, wherein said side parts of said tapered insertion section converge toward one another as said connecting section is approached, said side parts of said tapered insertion section being longitudinal continuations of said side parts of said fastening section.

3. A contact element according to claim 1, wherein said opening extends longitudinally between said fastening section and said connection section.

4. A contact element according to claim 1, wherein said opening has a circular configuration.

5. A contact element according to claim 1, wherein said opening has a generally oval configuration which has a longitudinal length substantially equal to the longitudinal length of said tapered insertion section.

6. A contact element according to claim 1, wherein said opening has a generally elliptical configuration which has a longitudinal length substantially equal to the longitudinal length of said tapered insertion section.

7. A contact element according to claim 1, wherein said web extends longitudinally into said tapered insertion section, said opening being disposed in the portion of the web extending into said tapered insertion section.

* * * * *